US007121759B2

(12) United States Patent
Woodson et al.

(10) Patent No.: US 7,121,759 B2
(45) Date of Patent: Oct. 17, 2006

(54) GRATING SYSTEM

(75) Inventors: Darryle D. Woodson, Massillon, OH (US); Joseph S. Mullane, Newcomerstown, OH (US); Thomas J. Snyder, Dover, OH (US); John C. Bartley, Canton, OH (US); Kenneth P. Apperson, Canton, OH (US)

(73) Assignee: Ohio Gratings, Inc., Canton, OH (US)

( * ) Notice: Subject to any disclaimer, the term of this patent is extended or adjusted under 35 U.S.C. 154(b) by 0 days.

(21) Appl. No.: 10/937,713

(22) Filed: Sep. 9, 2004

(65) Prior Publication Data

US 2006/0078377 A1 Apr. 13, 2006

(51) Int. Cl.
*E03F 5/06* (2006.01)

(52) U.S. Cl. ..... 404/2; 210/164; 52/653.1

(58) Field of Classification Search ..... 52/653.1, 52/664, 668; 404/2; 210/163, 164
See application file for complete search history.

(56) References Cited

U.S. PATENT DOCUMENTS 1,214,928 A * 2/1917 Lachman ..... 52/668
2,509,732 A * 5/1950 Ernestus ..... 52/667
2,645,985 A * 7/1953 Beebe et al. ..... 52/667
2,834,267 A * 5/1958 Beebe ..... 52/667
2,952,905 A * 9/1960 Lorig ..... 29/897.15
3,881,832 A * 5/1975 Maguire ..... 404/4
4,046,482 A * 9/1977 Paasch ..... 404/4
4,409,770 A * 10/1983 Kawaguchi et al. ..... 52/666
4,661,245 A * 4/1987 Rutherford et al. ..... 209/399
4,761,930 A * 8/1988 Tepera ..... 52/669
4,897,299 A * 1/1990 Kawachi et al. ..... 428/131
5,463,786 A * 11/1995 Mangone et al. ..... 14/73
5,733,445 A * 3/1998 Fanelli ..... 210/164
5,864,910 A * 2/1999 Mangone ..... 14/73
6,706,172 B1 * 3/2004 Strawser, Sr. ..... 210/164
6,908,549 B1 * 6/2005 Middleton et al. ..... 210/164

* cited by examiner

*Primary Examiner*—Gary S. Hartmann
(74) *Attorney, Agent, or Firm*—Sand & Sebolt

(57) ABSTRACT

A grating system includes a first welded subassembly and a second non-welded subassembly joined to one another. The first subassembly includes spaced elongated bearing bars and spaced elongated cross bars extending transversely to the bearing bars. The second subassembly includes spaced elongated filler bars and spaced elongated cross bars extending transversely to the filler bars. The filler bars extend in the same direction as the bearing bars and are disposed in sets between adjacent bearing bars. The bearing bars include spaced notches in which are received the first subassembly cross bars and the second subassembly cross bars, which are aligned above the first subassembly cross bars. The subassemblies have respective upper surfaces which are flush with one another. The first subassembly is configured to support vehicle traffic and the second subassembly is configured to support pedestrian traffic.

35 Claims, 13 Drawing Sheets

GRATING SYSTEM

BACKGROUND OF THE INVENTION

1. Technical Field

The invention relates generally to grates and grating systems. More particularly, the invention relates to the combination of heavy duty grating subassemblies with lighter duty grating subassemblies such as those used to accommodate both vehicle traffic and pedestrian traffic. Specifically, the invention relates to the combination of a heavy duty grating subassembly formed by welding and a lighter duty grating subassembly formed without welding.

2. Background Information

Within the broad world of grates and grating systems, there is an area which is configured to accommodate vehicle traffic, such as cars and trucks. Such grating involves the use of relatively heavy duty construction. There is also an area of grating to accommodate the walking traffic of pedestrians, and this type of grating involves relatively light weight construction. However, there are locations common to both vehicle and pedestrian traffic and thus there is a need for a grating system which accommodates both groups. The lighter duty construction typically used for pedestrian traffic is not sufficiently strong to support vehicle traffic. On the other hand, the heavy duty grating typically used for vehicle traffic is more costly and weighs a great deal more than the lighter gauge materials.

Typically, the heavy duty grating used for vehicle traffic may use a much greater mesh size than that used for pedestrian traffic. As a result, the spacing between the members of the grating is too great to appropriately accommodate pedestrian traffic. This spacing issue was amplified by the 1990 Americans with Disabilities Act, which required that openings between grating bars be no more than ½ inch in the primary direction of travel, thus better accommodating persons using wheelchairs and walking canes.

One option for resolving this problem is to simply build a grate from the heavy duty materials with a smaller mesh to accommodate pedestrian traffic. This may be achieved, for example, with a grating assembly including bearing bars with cross bars perpendicularly attached thereto by welding or swaging. However, this is very costly and increases the weight of the grating far beyond what is needed in order to accomplish this task. Such a product results in a fairly inefficient strength to weight ratio.

Another possibility is to use filler bars which run parallel to the bearing bars and are disposed between each adjacent pair of bearing bars. Such filler bars may be punched to create notches along one side thereof for receiving the cross bar of the grating. This type of construction presents several problems. First, the filler bars must be installed individually after the bearing bars have been welded to the cross bars. Each filler bar is welded to the cross bar at each intersection to keep the filler bar in place. This is a very time consuming process. In addition, the large number of welds on top of the grating assembly leads to heat induced stresses in the assembly that make it difficult to keep the panel flat. The problems associated with this type of construction limit the widths and spans of grating panels that may be manufactured by this method. Thus, there is a need for a combination of heavy duty grating with relatively light weight grating in order to provide a grating system appropriate for both vehicle and pedestrian traffic.

BRIEF SUMMARY OF THE INVENTION

The present invention provides a grating system comprising a first grating subassembly including a plurality of members joined to one another by a first joining mechanism; and a second grating subassembly joined to the first grating subassembly; the second grating subassembly including a plurality of members joined to one another by a second joining mechanism different than the first joining mechanism.

DETAILED DESCRIPTION OF THE INVENTION

Figure 1:
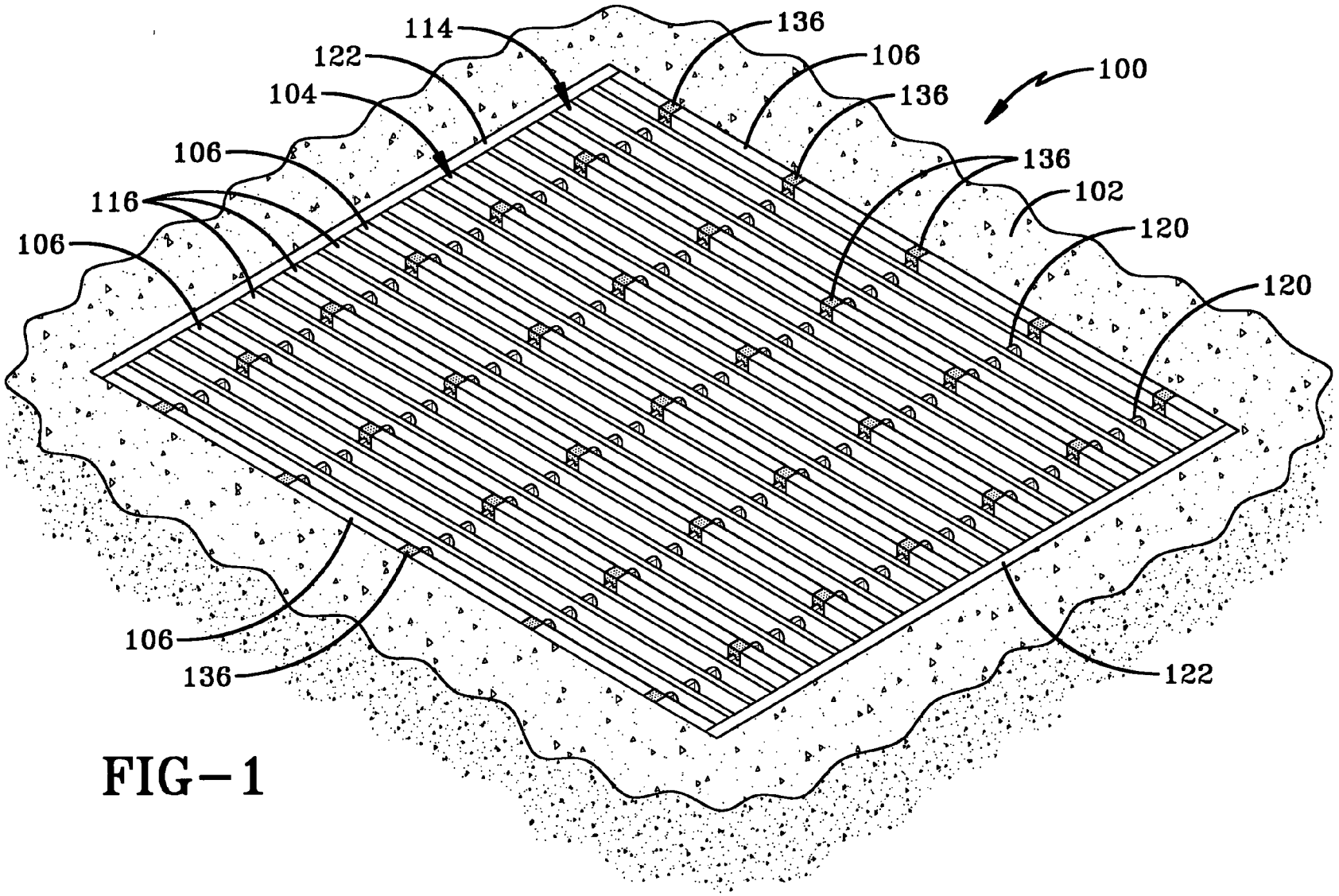
FIG. 1 is a perspective view of a first embodiment of the grating system of the present invention as it would appear when installed.
Figure 16:
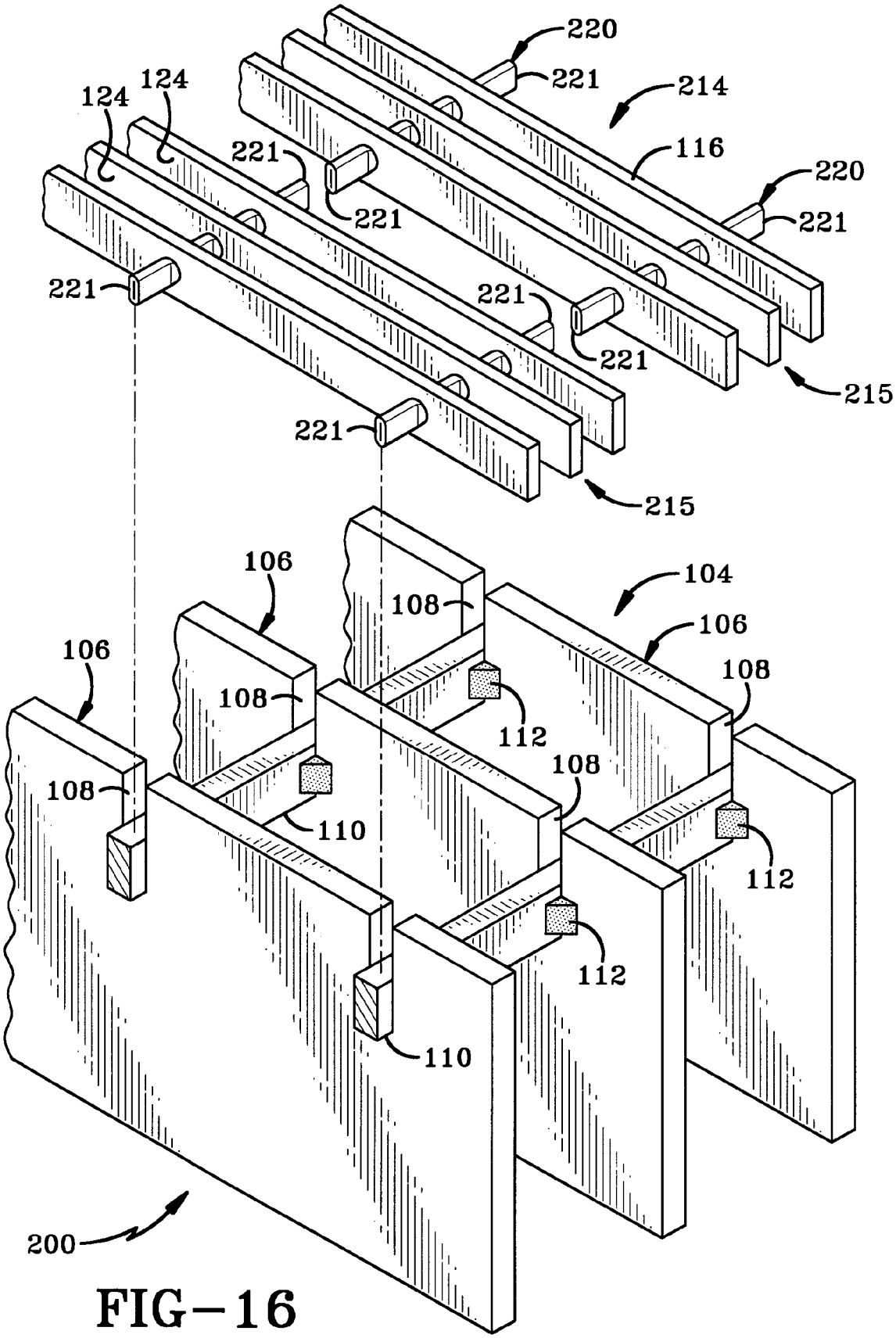
FIG. 16 is an enlarged fragmentary perspective view of a second embodiment of the grating system of the present invention showing the assembled welded grating assembly and the assembled non-welded grating assembly formed in smaller sections, as seen prior to the assembly of the two together.
Figure 17:
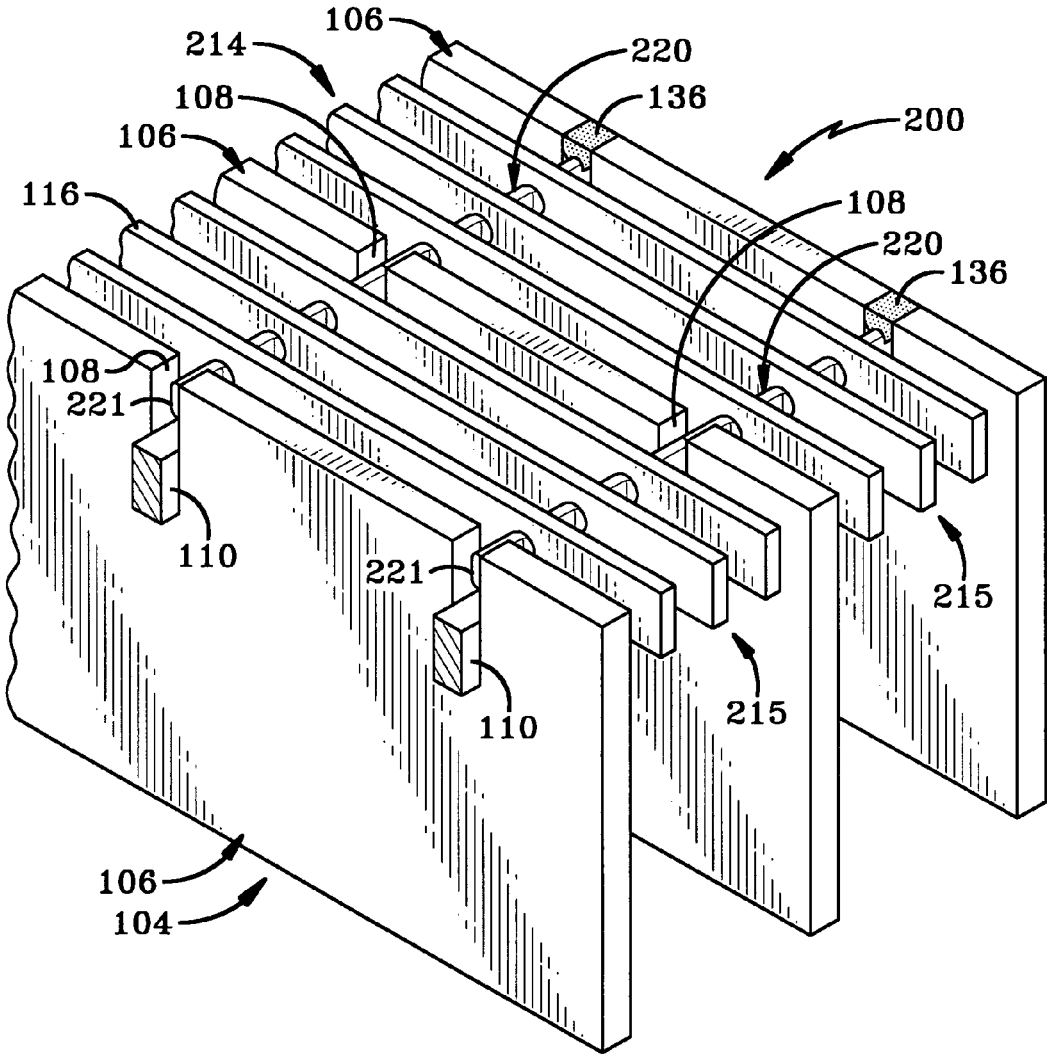
FIG. 17 is an enlarged fragmentary perspective view showing the second embodiment of the grating system assembled with some of the welds removed to show how the non-welded grating assembly is seated on the welded grating assembly.
Figure 18:
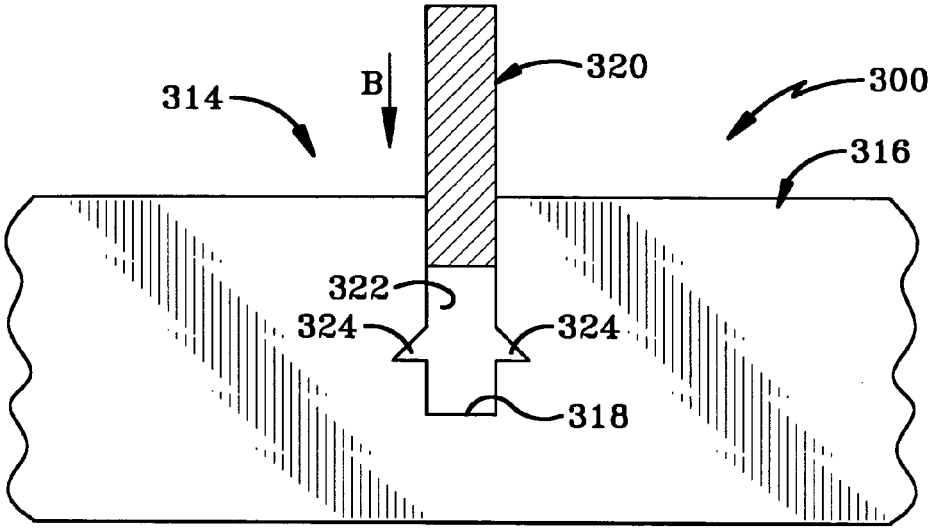
FIG. 18 is an enlarged fragmentary sectional view of a third embodiment of the non-welded grating assembly in an early stage of assembly showing a cross bar being inserted into the dove tail slot of a filler bar.
Figure 19:
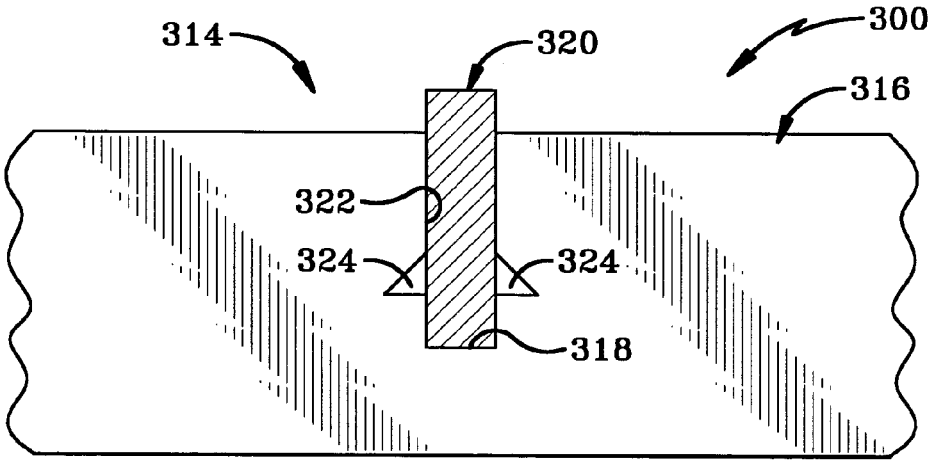
FIG. 19 is similar to FIG. 18 except in a further stage of assembly.
Figure 20:
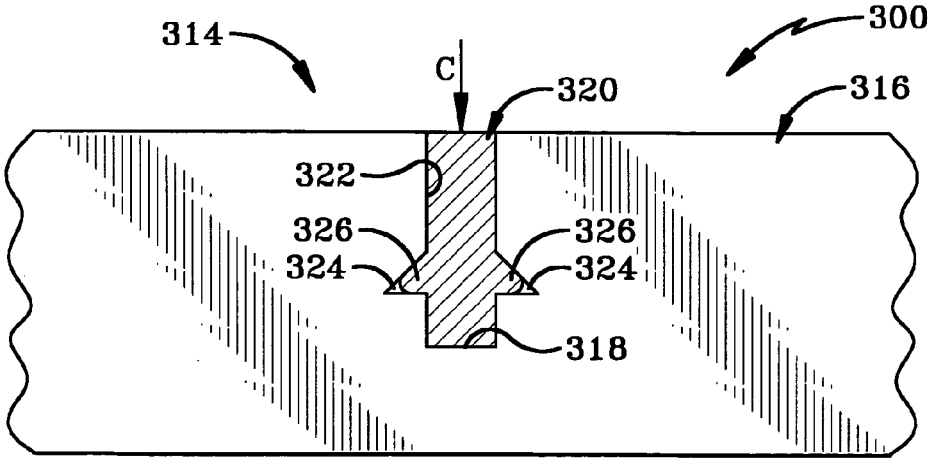
FIG. 20 is similar to FIG. 19 but shows the final assembly.

The grating system of the present invention is shown in three embodiments, the first embodiment shown generally at 100 in FIG. 1, the second embodiment shown at 200 in FIGS. 16–17, and the third embodiment shown at 300 in FIGS. 18–20. Grating systems 100, 200 and 300 are configured for use with vehicle traffic and pedestrian traffic and are suitable for use along roadways, sidewalks, bridges, in industrial buildings and so forth.

Figure 2:
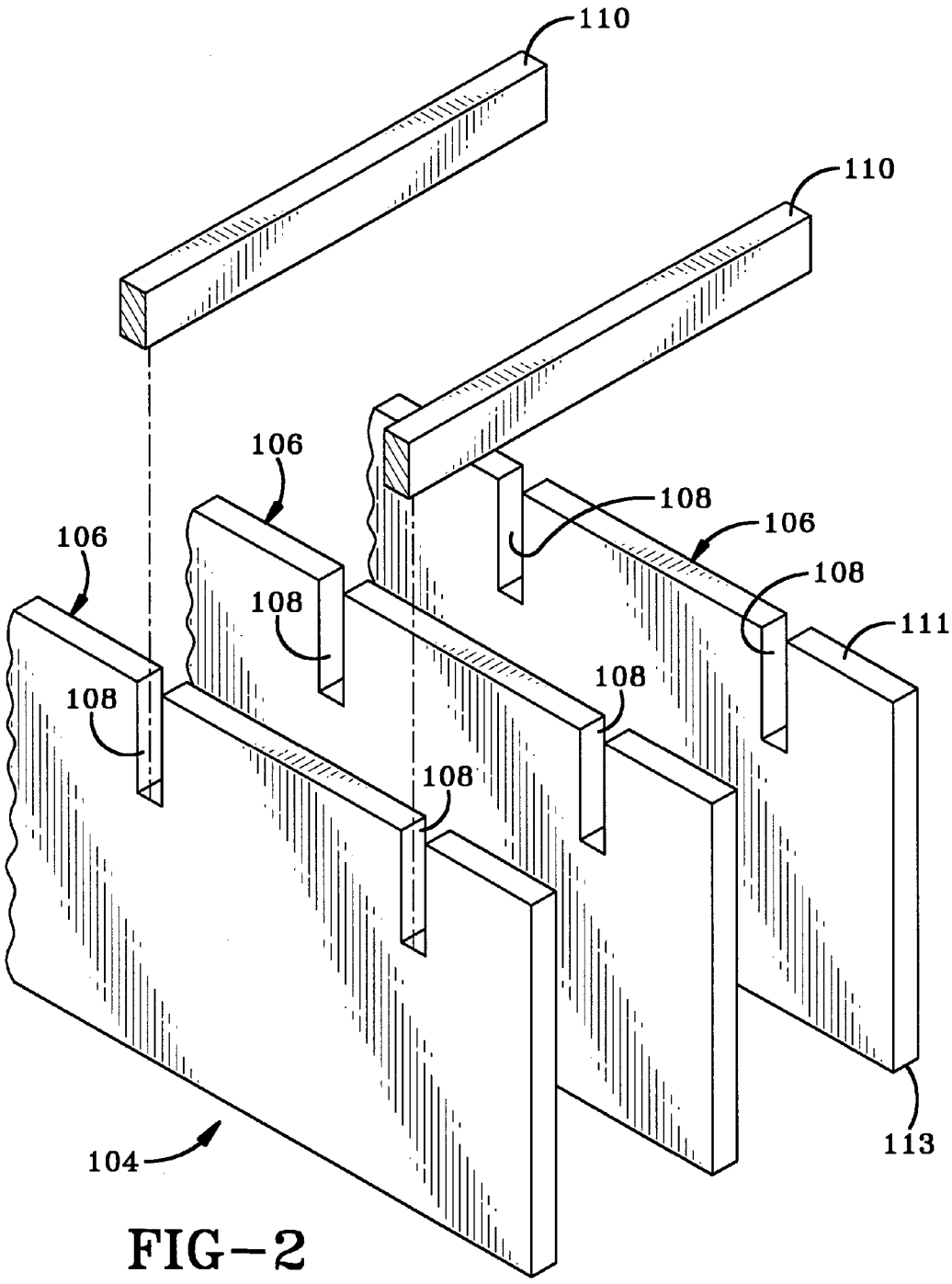
FIG. 2 is an enlarged fragmentary perspective view of the bearing bars and cross bars of the heavy duty grating assembly of the first embodiment prior to assembly.
Figure 3:
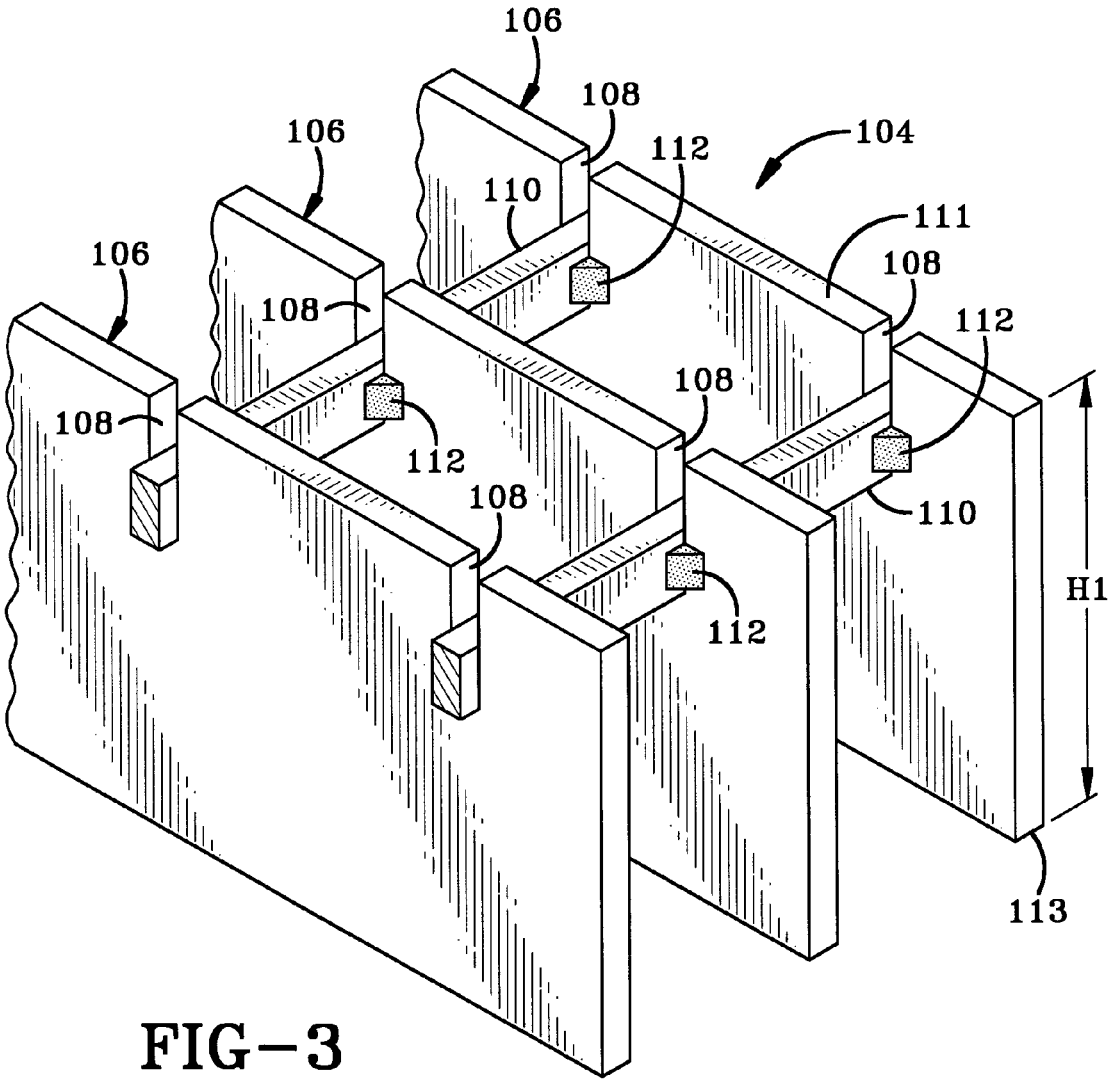
FIG. 3 is an enlarged fragmentary perspective view of the welded heavy duty grating assembly of the first embodiment when assembled.

With reference to FIGS. 1–4 and 11, grating system 100 is described. System 100 is shown installed flush with a ground surface 102 such as a sidewalk or pavement. With reference to FIGS. 1—3, system 100 includes a relatively heavy duty first grating subassembly 104 which includes a plurality of first members in the form of substantially parallel elongated bearing bars 106 defining spaced slots 108 and a plurality of second members in the form of elongated cross bars 110 disposed in slots 108 and welded to bearing bars 106 at welds 112. Cross bars 110 are seated on bearing bars 106 within slots 108. Cross bars 110 are substantially perpendicular to bearing bars 106. Subassembly 104 has an upper surface 111 and a lower surface 113 defining therebetween a height H1 (FIG. 3) which is also the height of bearing bar 106. Bearing bars 106 are elongated in a horizontal direction and are substantially flat plates oriented along respective parallel vertical planes.

Figure 4:
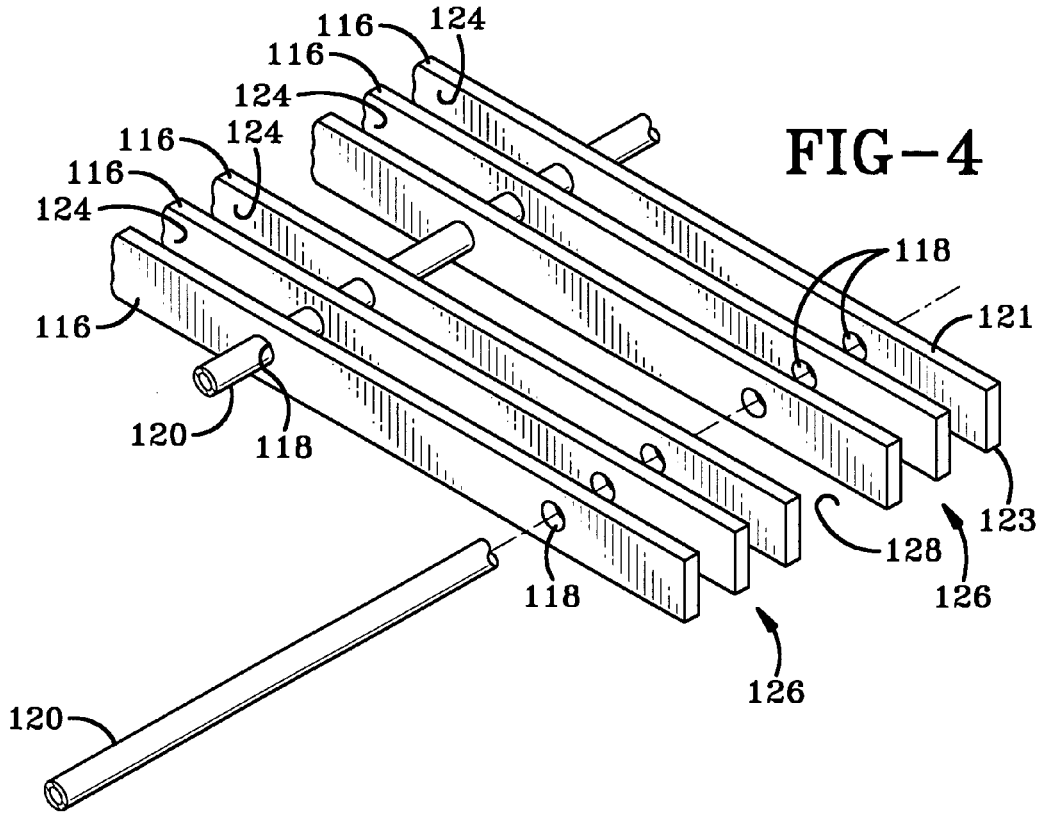
FIG. 4 is an enlarged fragmentary perspective view of the lighter duty non-welded grating assembly of the first embodiment in an early stage of assembly.
Figure 11:
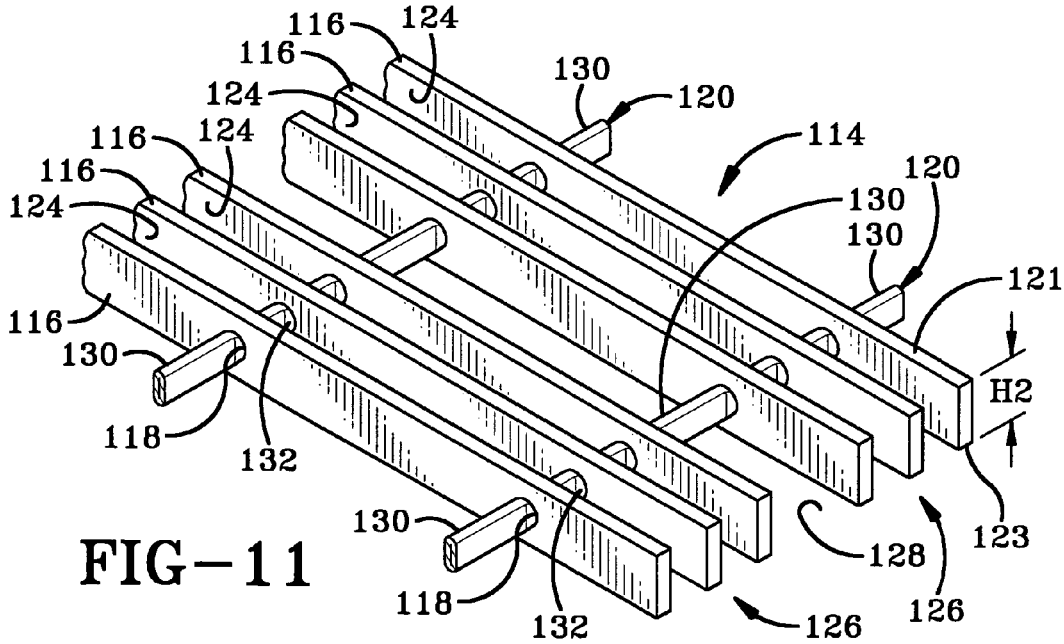
FIG. 11 is an enlarged fragmentary perspective view of the non-welded grating assembly of the first embodiment in the fully assembled configuration.

With reference to FIGS. 1, 4 and 11, system 100 also includes a relatively light duty second grating subassembly 114 formed by a plurality of third members in the form of substantially parallel elongated filler bars 116 defining spaced holes 118 and a plurality of fourth members in the form of cylindrical elongated cross bars 120 which are received by respective holes 118 so that cross bars 120 and filler bars 116 are substantially perpendicular to one another. Filler bars 116 and cross bars 120 are joined to one another without welding. Grating assemblies 104 and 114 are assembled as described hereafter to form grating system 100, which may additionally include an elongated capping frame member 122 (FIG. 1) to cap the ends of bearing bars 106 and filler bars 116. Subassembly 114 has an upper surface 121 and a lower surface 123 defining therebetween a height of H2 (FIG. 11). Filler bars 116 and cross bars 120 of subassembly 114 are formed of lighter gauge materials then are bearing bars 106 and cross bars 110.

Figure 5:
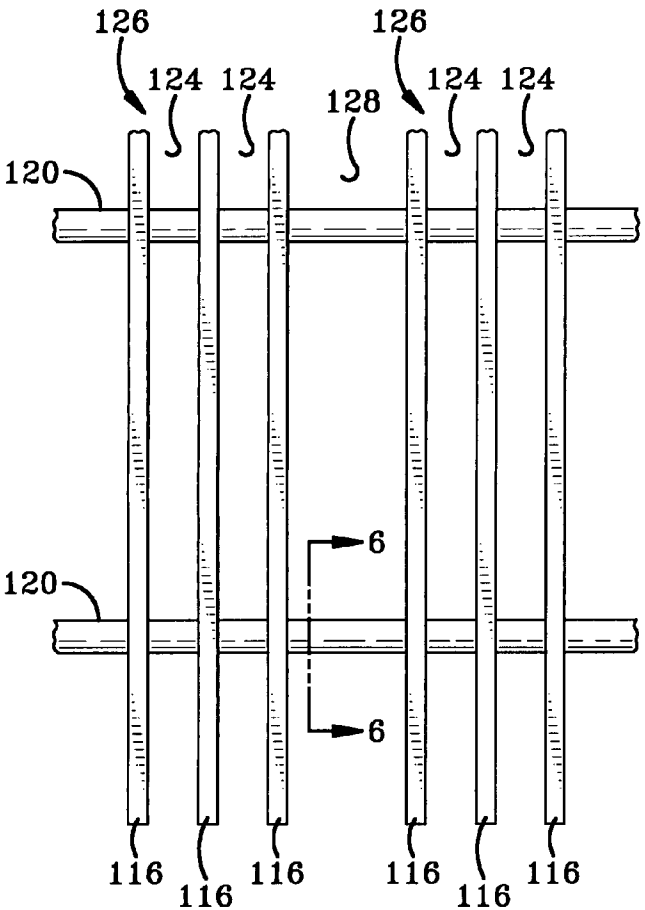
FIG. 5 is an enlarged fragmentary top plan view of the non-welded grating assembly in a further stage of assembly.
Figure 6:
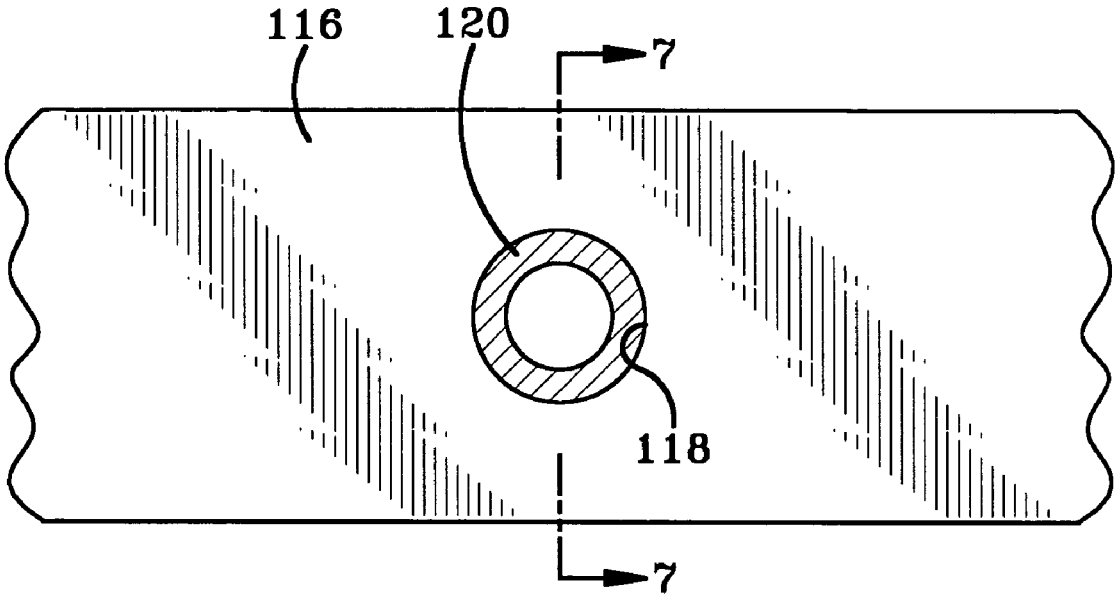
FIG. 6 is a sectional view taken on line 6—6 of FIG. 5.
Figure 9:
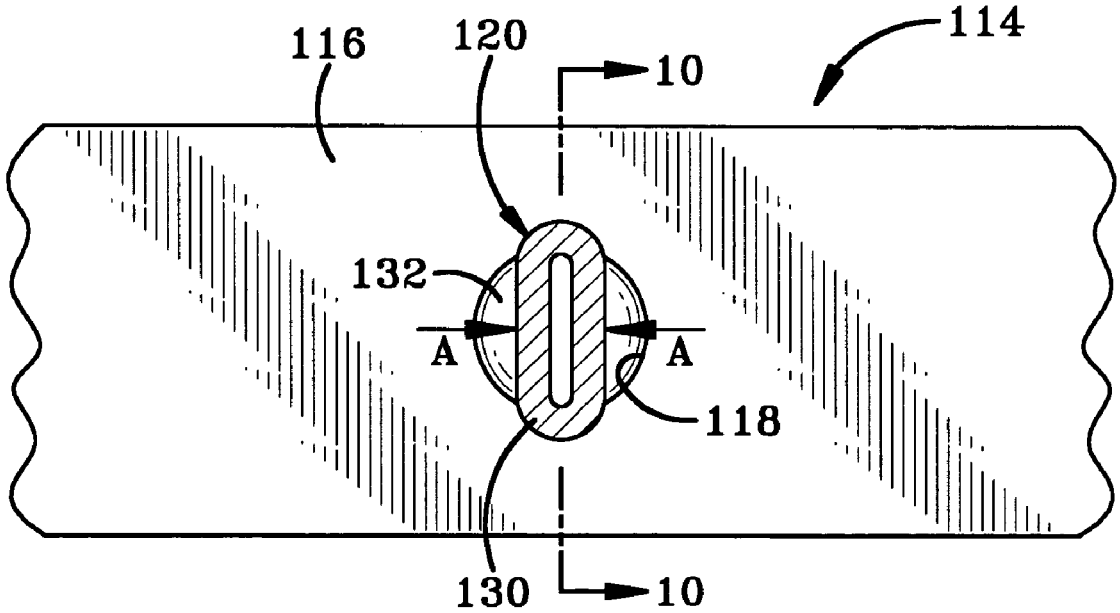
FIG. 9 is a sectional view taken on line 9—9 of FIG. 8.
Figure 7:
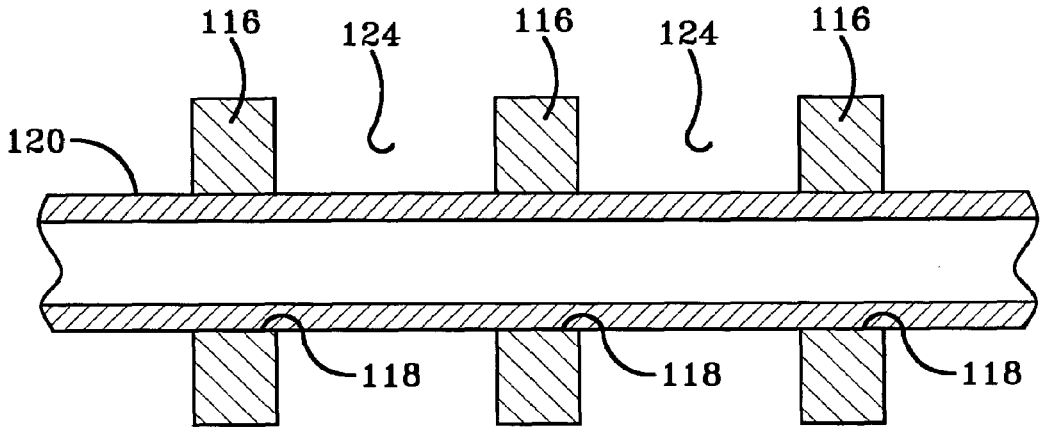
FIG. 7 is a sectional view taken on line 7—7 of FIG. 6.
Figure 10:
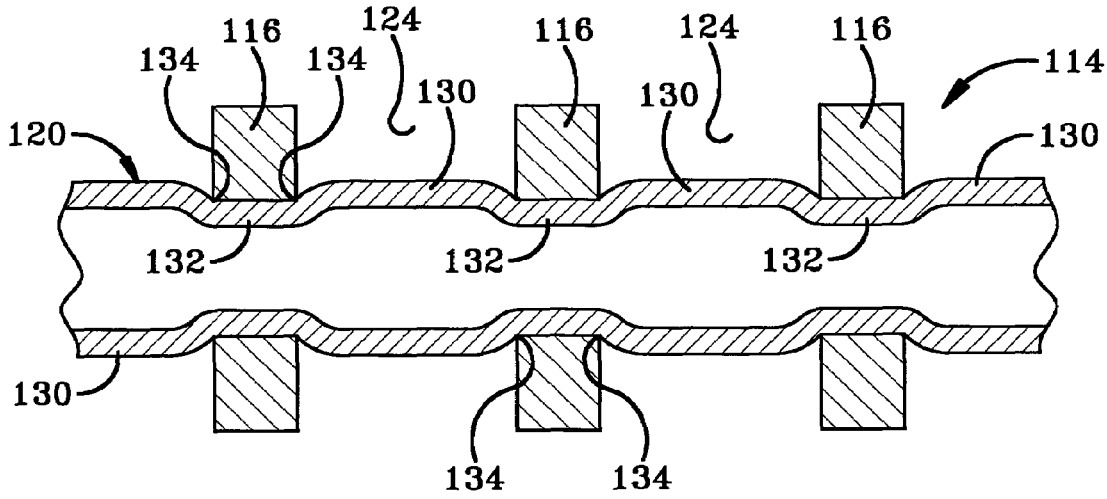
FIG. 10 is a sectional view taken on line 10—10 of FIG. 9.

With reference to FIGS. 4–11, the assembly of non-welded grating subassembly 114 is described. With reference to FIG. 4, filler bars 116 are positioned so that they are spaced from one another and parallel to one another with respective holes 118 of each filler bar 116 aligned. Cross bar 120 is then inserted into aligned holes 118 in order to form the basic layout of grating subassembly 114. More particularly, a plurality of filler bars 116, in this case three, are spaced from one another to form substantially equidistant spaces 124 between each adjacent pair of filler bars 116. These three filler bars 116 form a set 126 with a given pattern of spacing and this pattern is repeated again in other sets 126. Each set 126 of the bars 116 is spaced from one another by a larger width space 128 which receives a respective bearing bar 106 of welded grating subassembly 104 when grating assemblies 104 and 114 are joined together. FIG. 5 shows the relative spacing of spaces 124 and 128 and also shows cross bar 120 in its cylindrical form prior to the rigid connecting of filler bars 116 and cross bars 120. FIGS. 6 and 7 also show the cylindrical form of cross bar 120 within spaces 124 and 128 prior to filler bars 116 and cross bars 120 being rigidly fixed to one another.

Figure 8:
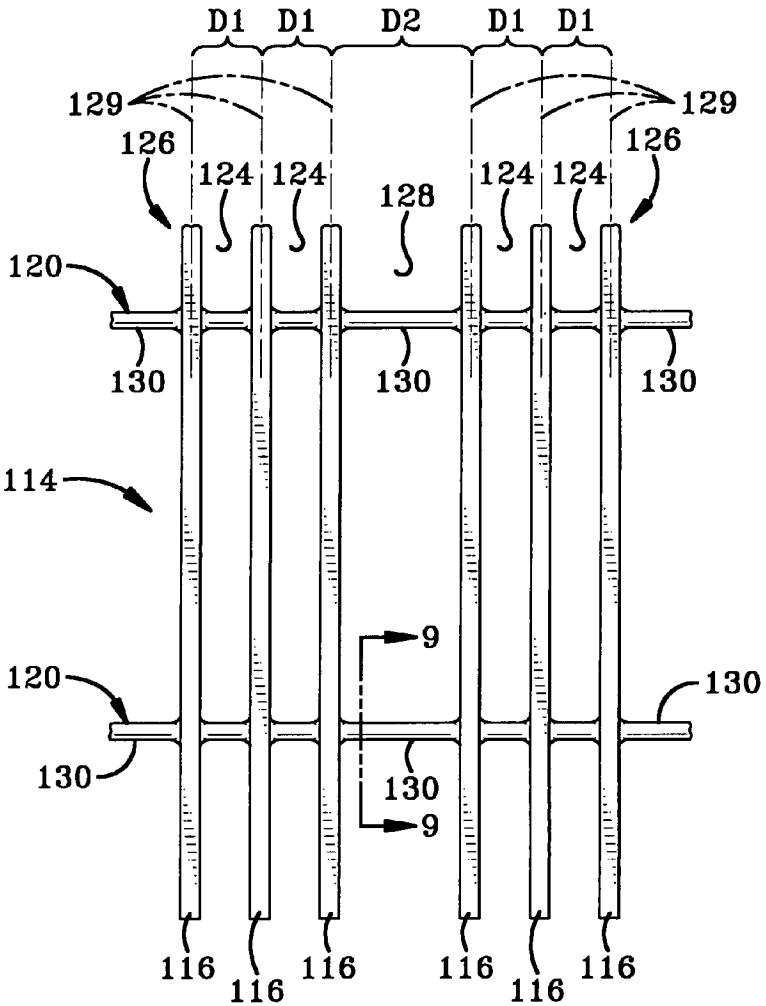
FIG. 8 is similar to FIG. 5 except showing the non-welded assembly in a fully assembled configuration.

Further regarding spaces 124 and 128 and with reference to FIG. 8, each filler bar 116 has a center line 129. Each adjacent center line 129 within a given set 126 of bars 116 is spaced by a distance D1. Center lines 129 of the adjacent filler bars 116 which are separated by space 128 define therebetween a distance D2. Distance D2 is larger than distance D1 and most preferably is twice the distance of D1, as further detailed below.

FIGS. 8–11 show non-welded grating subassembly 104 after filler bars 116 and cross bars 120 have been rigidly connected to one another. This is done by the crimping of cross bars 120 within spaces 124 and 128 as indicated by Arrows A in FIG. 9. After the crimping, swaging or other manipulation of cross bars 120, each cross bar 120 includes crimped or deformed portions 130 within spaces 124 and 128. Deformed portions 130 alternate with cylindrical or substantially undeformed portions 132 passing through respective holes 118 of respective filler bars 116. The deformation of cross bars 120 to form deformed portions 130 creates shoulders 134 which act as stops to prevent or severely limit movement of filler bars 116 along the length of cross bars 120 via an interference fit. Thus, filler bars 116 and cross bars 120 are rigidly fixed to one another.

Figure 12:
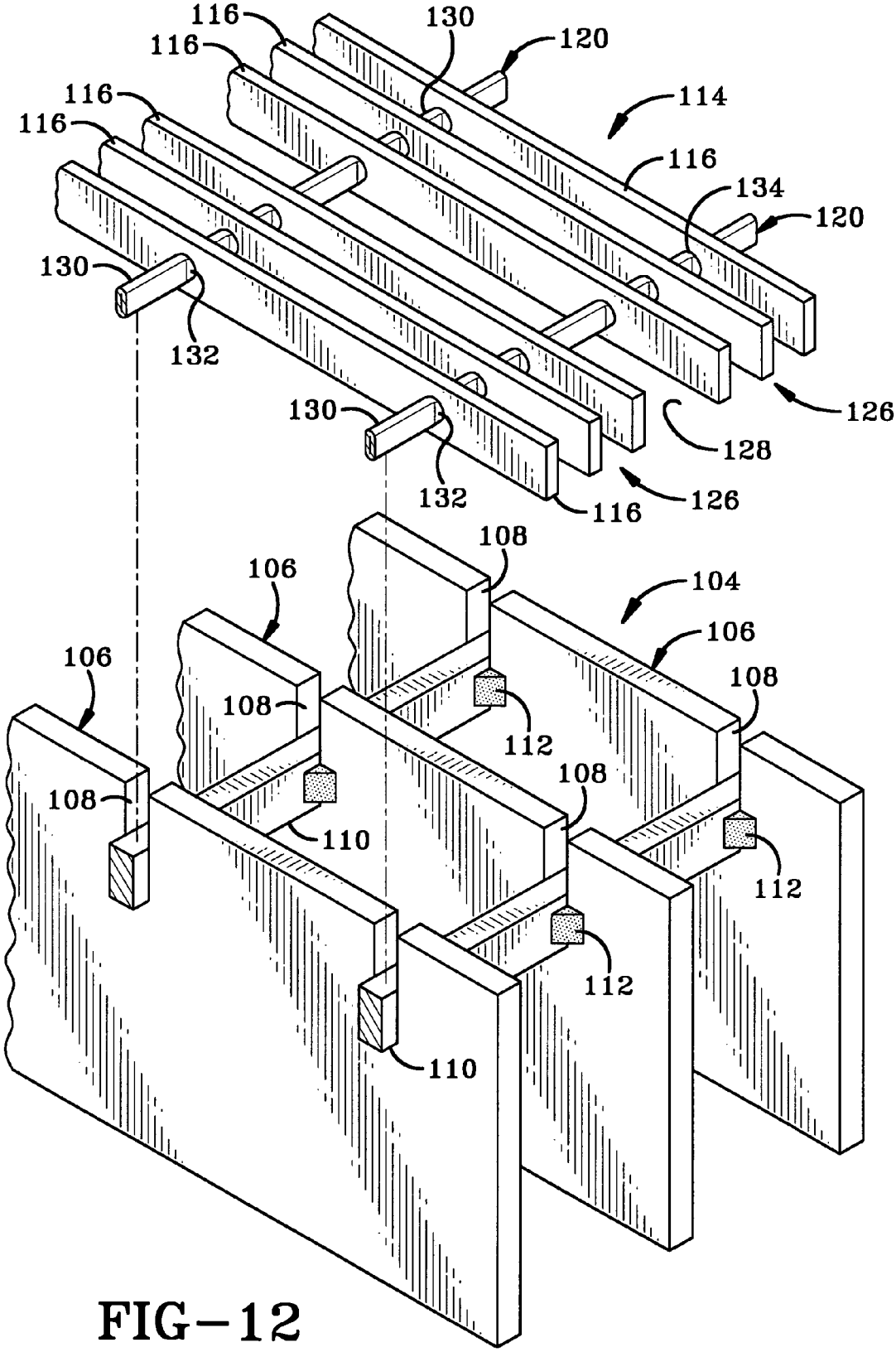
FIG. 12 is an enlarged fragmentary perspective view showing the assembled welded grating assembly and the assembled non-welded grating assembly of the first embodiment prior to assembling the two together.
Figure 13:
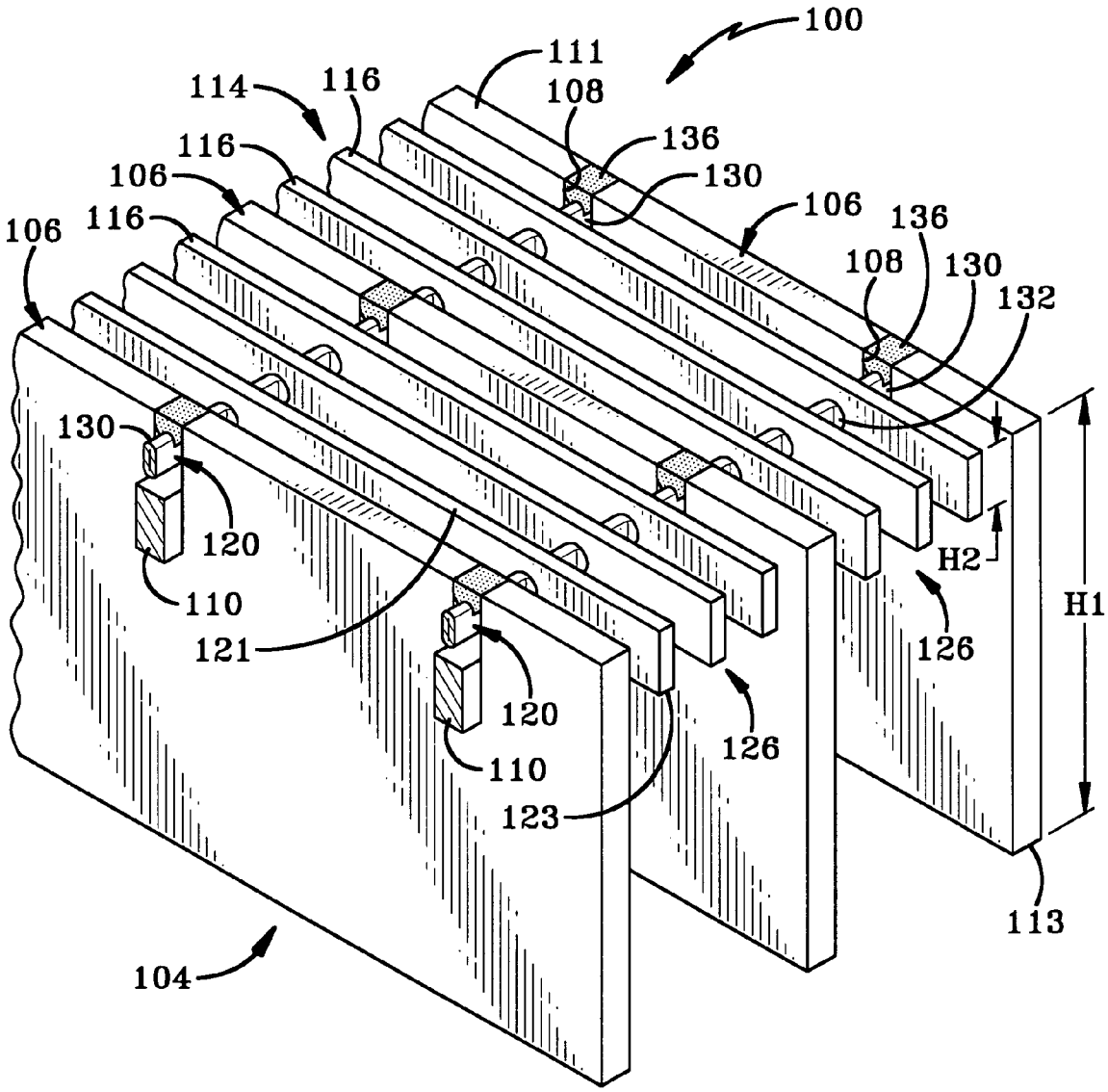
FIG. 13 is an enlarged fragmentary perspective view of the grating system of the first embodiment fully assembled.

In accordance with one of the main features of the present invention and with reference to FIGS. 12–13, non-welded grating subassembly 114 is aligned with welded grating subassembly 104, brought together and rigidly joined as by welds 136 (FIG. 13). More particularly, deformed portions 130 within spaces 128 are inserted into slots 108 of bearing bars 106 above cross bars 110 of welded subassembly 104 so that cross bars 120 are aligned with and spaced upwardly of cross bars 110. Thus, the spacing between each adjacent pair of cross bars 120 is substantially equal to the spacing between each adjacent pair of cross bars 110. In addition, each set 126 of filler bars 116 is inserted between each adjacent pair of bearing bars 106 so that filler bars 116 are seated on cross bars 110 of welded subassembly 104 (FIG. 15) to transfer weight from filler bars 116 to bearing bars 106 via cross bars 110. Cross bars are then welded to bearing bars 106 at welds 136 to join assemblies 104 and 114 to form grating system 100. If desired, capping frame member 122 may then be attached to the ends of bearing bars 106 and filler bars 116 to cover exposed edges and increase structural strength (FIG. 14).

When subassemblies 104 and 114 are joined (FIG. 13), upper surface 111 of subassembly 104 and upper surface 121 of subassembly 114 are substantially flush with one another. As shown in FIG. 13, height H1 of subassembly 104 is substantially greater than H2 of subassembly 114 and also defines the total height of system 100. Preferably, height H2 is no more than one half (½) of height H1. More preferably, height H2 is no more than one third (⅓) of height H1. More preferably, height H2 is no more than one fourth (¼) of height H1. Most preferably, height H2 is no more than one sixth (⅙) of height H1.

Thus, grating system 100 provides sufficient strength via heavy duty welded grating subassembly 104 to support vehicle traffic including trucks. Typically, the spacing between each adjacent pair of bearing bars 106 ranges from 15/16 to 3 inches, although this spacing may vary. In addition, system 100 provides the spacing between adjacent filler bars 116 and between each bearing bar 106 and filler bars 116 adjacent thereto which is suitable for pedestrian traffic without using the heavier gauge materials required to provide the strength for vehicle support. Said spacing can vary depending on the environment, but can be made suitably small enough, for example, to accommodate the spikes of high heel shoes, especially in places like city streets and sidewalks where the use of such high heel spikes is fairly common. Where it is desired to comply with the Americans with Disabilities Act of 1990, as noted in the Background section of this application, the spacing between adjacent filler bars 116 and between each bearing bar 106 and filler bars 116 adjacent thereto is no more than ½ inch. The preferred range for this spacing is from ⅛ to ½ inch for pedestrian traffic including those using canes and wheelchairs.

Figure 14:
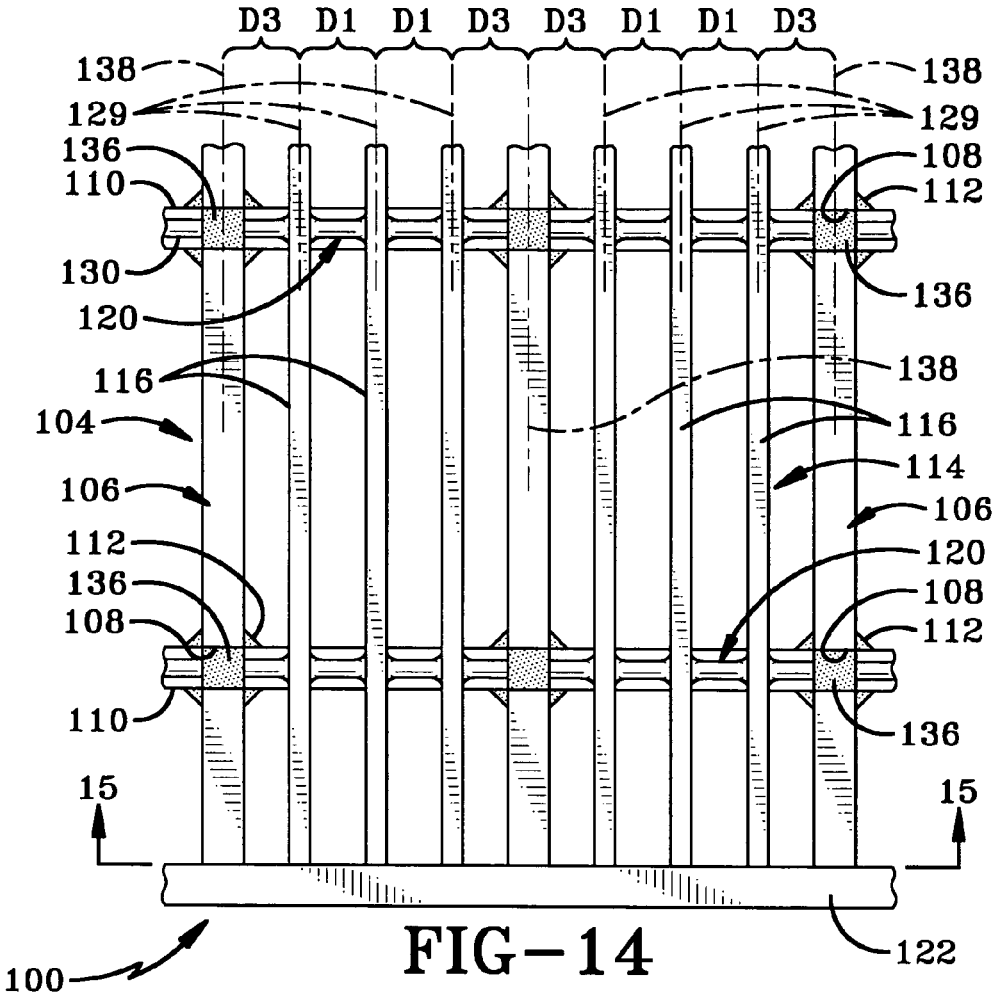
FIG. 14 is an enlarged fragmentary top plan view of the grating system of FIG. 13 and further including the outer capping frame member.
Figure 15:
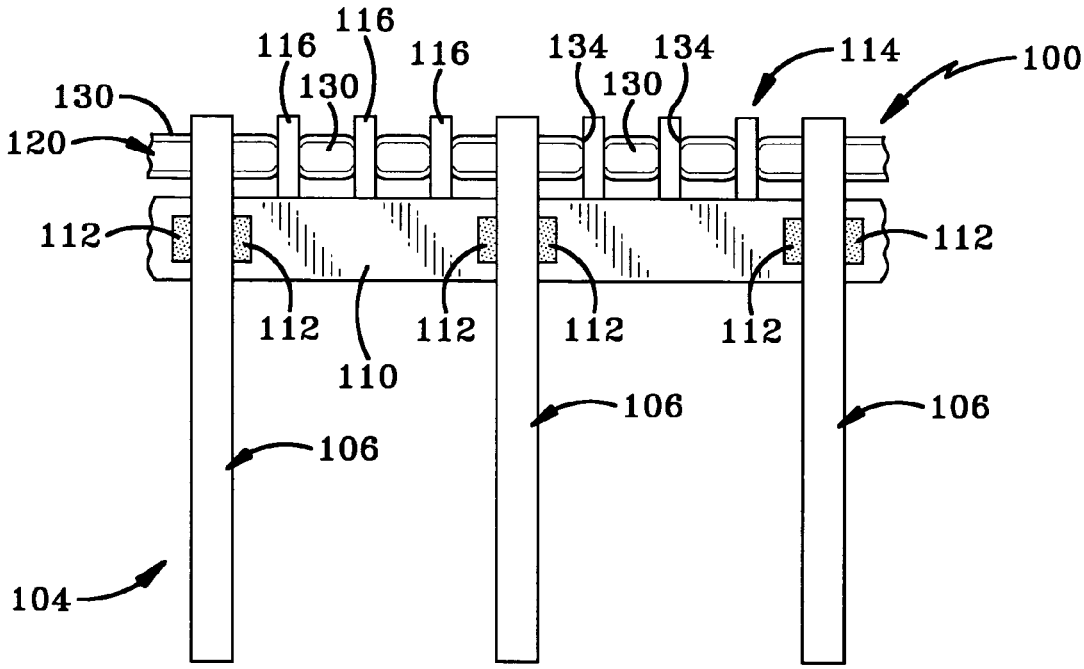
FIG. 15 is a side elevational view taken on line 15—15 of FIG. 14.

Further regarding this spacing and with reference to FIG. 14, bearing bars 106 have center lines 138. Each center line 138 and an adjacent center line 129 of filler bar 116 defines a distance D3 therebetween. As previously noted, distance D2 is twice that of distance D1. It is also most preferable that distance D3 equals distance D1 although these distances may all vary. However, these most preferred distances D1, D2 and D3 allow the use of bearing bars 106 which have a range of gauges while still allowing center line 138 to be halfway between respective center lines 129 so that each bearing bar 106 is evenly spaced from each adjacent filler bar 116 and so that this distance equals the distance D1 between filler bars 116. While a variety of gauges of bearing bars 106 may be used without being centrally spaced between filler bars 116, the even spacing between center lines 138 and 129 provides an aesthetic look which is generally more desireable. This spacing is also beneficial when using smaller size non-welded panels, as discussed further below with regard to grating system 200.

The strength of system 100 to support vehicles in combination with a lighter weight overall structure to accommodate pedestrian traffic thus reduces the weight and cost to produce such a grating system. The lighter weight of system 100 is due in part to the use of lighter gauge members to form subassembly 114 than the members used to form subassembly 104. Another factor is the smaller height H2 of subassembly 114 compared to height H1 of subassembly 104. Further, non-welded grating subassembly 114 is relatively simple to form and does not require the additional time for welding between its members. Nonetheless it is sufficiently strong for the purpose and provides a panel or assembly which may be preformed and stocked for use with a variety of heavy duty welded grating subassemblies having a variety of sizes of bearing bars and cross bars, thus reducing the lead time necessary to produce grating system 100 or a similar configuration. Moreover, the crimped or swaged nature of joining cross bars 120 and filler bars 116 to form non-welded grating subassembly 114 allows for very consistent spacing between filler bars 116 and cross bars 120, which is far more difficult to achieve with welded assemblies which are of relatively light-weight construction. Thus, the consistent spacing offered by the non-welded light weight subassembly facilitates aligning the light weight subassembly with and connecting it to the welded heavy duty subassembly.

Grating system 100 may also be produced with substantially longer spans and widths than the prior art discussed in the Background of the present application. Further, appearances are improved because fewer welds are required per square foot and a wide variety of spacing combinations is easily provided with virtually no additional tooling costs with regard to the non-welded subassembly.

Grating system 200 is now described with reference to FIGS. 16–17. System 200 is very similar to system 100 except that light duty non-welded grating subassembly 214 is created in smaller segments than is grating subassembly 114. More particularly, grating subassembly 214 is formed by a plurality of sections 215 which include a plurality of filler bars 116, in sets of three as with system 100. The spacing between each adjacent pair of filler bars 116 is the same as with system 100 and is still numbered at 124. Instead of longer cross bars like cross bars 120 of system 100 extending through holes 118 of filler bars 116, shorter cross bars 220 having opposed ends 221 are used, although they are crimped or swaged in the same manner as with system 100 in order to join cross bars 220 rigidly to filler bars 116.

There is no change to welded grating subassembly 104 in system 200 and thus the spacing requirements regarding non-welded grating subassembly 214 is analogous to that of grating subassembly 114. To that effect, the length of cross bars 220 is set so that each interiorly disposed end 221 of cross bar 220 is in abutment or closely adjacent another interiorly disposed end 221 of the cross bar 220 of an adjacent section 215 of non-welded subassembly 214 when joined to welded assembly 104, as seen in FIG. 17. Non-welded grating subassembly 214 is seated on welded subassembly 104 in the same manner as described with system 100 except for the positioning of the abutted ends 221 as just noted. Then cross bars 220 are welded to bearing bars 106 to rigidly join grating assemblies 214 and 104 to form system 200.

System 200 maintains the same spacing and distances D1, D2 and D3 as shown and described with regard to system 100. The even spacing between the center lines 129 and 138 as previously described allows the length of cross bars 220 to be set such that abutted ends 221 are disposed within respective slots 108 of respective bearing bars 106. This allows for the use of a plurality of sections 215 which are identical to one another and also provides a place for welding, at welds 136, which secures each section 215 to bearing bars 106 adjacent ends 221 of cross bars 220. This configuration allows each section 215 to be securely connected to the respective bearing bars 106 on either side of section 215.

System 200 thus provides an end product very similar to system 100. However, there are advantages to using smaller sections or panels such as sections 215. First, where grating subassembly 214 is assembled in advance and stocked in preparation for joining with welded subassembly 104, the smaller size of sections 215 as compared to a larger panel allows storage in smaller areas. The smaller structure also makes each section 215 lighter and less cumbersome prior to and during assembly with welded subassembly 104. Further, any irregularities in the formation of welded subassembly 104 may be better accommodated by smaller sections such as section 215 when non-welded subassembly 214 is joined to welded subassembly 104. The size of the panels may vary so as to extend only between adjacent pairs of bearing bars 106, as with sections 215, or as otherwise desired.

Grating system 300 is now described with reference to FIGS. 18–20. System 300 includes the welded grating subassembly 104 used with the first two embodiments and is distinct from the first two embodiments in that it provides a different non-welded grating subassembly 314. Grating subassembly 314 includes filler bars 316 defining dove tail slots 318 which receive cross bars 320 so that cross bars 320 are substantially perpendicular to filler bar 316. Each cross bar 320 is rectangular in cross section. Each slot 318 includes a rectangular portion 322 for matingly receiving a portion of a cross bar 320 and a pair of extensions or wing portions 324 extending outwardly on each side of rectangular portion 322.

To assemble grating subassembly 314, cross bar 320 is inserted into slot 318 in the direction indicated by Arrow B in FIG. 18. Once cross bar 320 is seated in the bottom of slot 318 as shown in FIG. 19, pressure is applied to cross bar 320 as indicated by Arrow C in FIG. 20 which forces portions 326 of cross bar 320 to bulge out into wing portions 324 of slot 318. This creates an interference between portions 326 and filler bars 316 within respective wing portions 324 to prevent the removal of cross bar 320 from slot 318, thus rigidly joining cross bars 320 to filler bars 316 to form non-welded subassembly 314. Similar to the first two embodiments, cross bars 320 would then be inserted into respective slots 108 of bearing bars 106 above cross bars 110 and filler bars 316 would similarly be seated on cross bars 110 of welded subassembly 104 to form grating system 300. One advantage of non-welded grating subassembly 314 is that it makes it easier to obtain a flush upper surface of system 300.

The exemplary embodiments shown are but a small fraction of the many possibilities for forming grating subassemblies. For example, while the heavy duty subassemblies described above use welding as a joining mechanism and the light duty subassemblies use an interference fit based on deformation of the cross bars, either of the subassemblies may use other joining mechanisms. Further, the bearing bars, filler bars and cross bars have a variety of shapes. In the embodiment shown, the cross bars and bearing bars making up the heavy duty subassembly are perpendicular to one another as are the filler bars and cross bars making up the lighter-duty subassembly. However, these bars may respectively be disposed transversely to one another. Similarly, the bearing bars and filler bars are parallel in the embodiment shown, but may be angled with regard to one another to some degree. While the grating systems shown herein are typically used for vehicle traffic and pedestrian traffic, it is contemplated that the combination of the subassemblies may be used in other contexts.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A grating system comprising:

a first grating subassembly including a plurality of members joined to one another by a first joining mechanism;

a second grating subassembly joined to the first grating subassembly; the second grating subassembly including a plurality of members joined to one another by a second joining mechanism different than the first joining mechanism;

wherein the second subassembly is formed separately from the first subassembly;

wherein the first and second subassemblies have respective upper surfaces which are flush with one another;

wherein the plurality of members of the first subassembly includes a plurality of first elongated members and a plurality of second elongated members joined to the first members by the first joining mechanism, the first members being transverse to the second members;

wherein the plurality of members of the second subassembly includes a plurality of third elongated members and a plurality of fourth elongated members joined to the third members by the second joining mechanism, the third members being transverse to the fourth members;

wherein the first and second subassemblies are joined to one another so that each adjacent pair of the first members receives there between at least one of the third members;

wherein the fourth members are disposed above and aligned with the second members.

2. The system of claim 1 wherein the first Joining mechanism is welding.

3. The system of claim 2 wherein at least one of the members of the second subassembly is deformed to join to at least one other of the members of the second subassembly by an interference fit to provide the second joining mechanism.

4. The system of claim 3 wherein the second subassembly is free of welds.

5. The system of claim 2 wherein the first and second subassemblies are joined to one another by welding.

6. The system of claim 1 wherein each first elongated member defines a plurality of spaced upwardly opening notches in which the second elongated members are disposed.

7. The system of claim 6 wherein at least one of the third elongated members is disposed between each adjacent pair of first elongated members; and wherein the fourth elongated members are disposed in the notches directly above the second elongated members.

8. The system of claim 7 wherein the third elongated members are seated on the second elongated members.

9. The system of claim 1 wherein the first members are substantially flat plates which are disposed in generally vertical planes, which are elongated in a generally horizontal direction and which define a first height of the first subassembly; and wherein the second subassembly has a second height which is no more than one third of the first height.

10. The system of claim 9 wherein the second height is no more than one fourth of the first height.

11. The system of claim 10 wherein the second height is no more than one sixth of the first height.

12. The system of claim 1 wherein the at least one third member is substantially evenly spaced between the adjacent first members.

13. The system of claim 1 wherein spacing between each adjacent pair of first members is in the range of 2 to 4 inches; wherein the spacing between each adjacent pair of third members is in the range of ⅜ to ½ inch; and wherein spacing between each first member and each third member adjacent thereto is in the range of ⅜ to ½ inch.

14. The system of claim 1 wherein the third members are in sets each having a plurality of third members; wherein the third members within each set are distinct from the third members within each other set; wherein each adjacent pair of third members in each set is spaced by a first distance; and wherein each adjacent set is spaced by a second distance greater than the first distance.

15. The system of claim 14 wherein the first and third elongated members each have center lines along the elongated direction of said respective members; and wherein the spacing between each adjacent center line is substantially equal.

16. The system of claim 1 wherein spacing between each adjacent pair of second members substantially equals spacing between each adjacent pair of fourth members; and wherein the second and fourth members are parallel to one another.

17. The system of claim 1 wherein the second subassembly is seated on the first subassembly; wherein the first subassembly is configured to support vehicle traffic; and wherein the first and third members are suitably spaced to accommodate pedestrian traffic thereon.

18. The system of claim 17 wherein the second members are seated on the first members and the third members are seated on the second members.

19. The system of claim 18 wherein the third members are substantially parallel to the first members.

20. The system of claim 1 wherein the second subassembly is seated on the first subassembly.

21. The system of claim 1 wherein the first subassembly is configured to support vehicle traffic and the second subassembly is configured to support pedestrian traffic.

22. The system of claim 21 wherein the second subassembly is seated on the first subassembly.

23. The system of claim 1 wherein each first elongated member defines a plurality of spaced upwardly opening notches;

wherein the fourth members are transverse to the first members;

wherein the second members are disposed in the notches;

wherein the first members include a pair of adjacent first members; wherein one of the adjacent first members defines a first one of the notches; wherein the other of the adjacent first members defines a second one of the notches;

wherein one of the fourth members extends between and is disposed in each of the first one and second one of the notches; and wherein at least one of the second members is disposed in each of the first one and second one of the notches.

24. The system of claim 23 wherein the one of the adjacent first members defines a third one of the notches; wherein the other of the adjacent first members defines a fourth one of the notches; wherein another of the fourth members extends between and is disposed in each of the third one and fourth one of the notches; and wherein at least one of the second members is disposed in each of the third one and fourth one of the notches.

25. The system of claim 24 wherein a second member and a fourth member is disposed in each notch.

26. The system of claim 23 wherein the first members define the upper surface of the first subassembly and the third members define the upper surface of the second subassembly.

27. The system of claim 23 wherein the third members are seated atop the second members.

28. The system of claim 1 wherein the second subassembly has unjoined and joined positions in which it is respectively separate from and joined to the first subassembly;

wherein each adjacent pair of first members defines therebetween a space;

wherein the third members are elongated in a direction generally the same as the first members; and wherein the second subassembly is movable downwardly from the unjoined position to the joined position to insert at least one of the third members in each of the spaces between respective adjacent pairs of first members so that each third member is spaced from each adjacent first member.

29. The system of claim 28 wherein the third members have upper surfaces and the fourth members have upper surfaces which are no higher than the upper surfaces of the third members.

30. The system of claim 28 wherein the first members have upper surfaces and the fourth members have upper surfaces which are no higher than the upper surfaces of the first members.

31. The system of claim 28 wherein the second subassembly is movable downwardly from the unjoined position to the joined position to insert a plurality of the third members in each of the spaces between respective adjacent pairs of first members.

32. The system of claim 31 wherein the plurality of third members in each of the spaces form respective sets; wherein each adjacent pair of third members in each set is spaced by a first distance; and wherein each adjacent set is spaced by a second distance greater than the first distance.

33. The system of claim 32 wherein the first and third elongated members each have center lines along the elongated direction of said respective members; and wherein the spacing between each adjacent center line is substantially equal.

34. The system of claim 28 wherein the third members are seated atop the second members.

35. The system of claim 28 wherein the first subassembly is configured to support vehicle traffic.

* * * * *